US005302809A

United States Patent [19]

Ghiassy

[11] Patent Number: 5,302,809

[45] Date of Patent: Apr. 12, 1994

[54] MIRROR DEFOGGER WITH ELONGATED FRAME MEMBER AND DOWNWARDLY EXTENDING HEATER SHEET

[76] Inventor: Abby Ghiassy, 8605 SW. Beaverton-Hillsdale Hwy., Portland, Oreg. 97225

[21] Appl. No.: 847,178

[22] Filed: Mar. 6, 1992

[51] Int. Cl.[5] ..... H05B 3/00

[52] U.S. Cl. ..... 219/219; 219/528; 219/522; 219/526

[58] Field of Search ..... 219/219, 528, 529, 549, 219/522, 213, 526, 520; 338/307, 308, 309; 392/439, 435, 438

[56] References Cited

U.S. PATENT DOCUMENTS

| | | | |
|---|---|---|---|
| 1,565,046 | 12/1925 | Bergdoll | 219/526 |
| 1,721,663 | 7/1929 | Holzhauer, Jr. | 219/526 |
| 1,914,454 | 6/1933 | Noble | 219/526 |
| 1,916,895 | 7/1933 | Rowe | 219/526 |
| 2,564,836 | 8/1951 | Elsenheimer | 219/219 |
| 3,160,736 | 12/1964 | Catterson | 219/219 |
| 3,530,275 | 9/1970 | Rust | 219/219 |
| 3,597,586 | 8/1971 | Rebovich | 219/219 |
| 3,961,157 | 6/1976 | Miller | 219/213 |
| 4,313,048 | 1/1982 | Holbrook | 219/526 |
| 4,382,177 | 5/1983 | Heaney | 219/522 |
| 4,665,304 | 5/1987 | Spencer | 219/219 |
| 4,697,065 | 9/1987 | Ishitsubo et al. | 219/219 |
| 4,857,711 | 8/1989 | Watts | 219/548 |
| 4,882,466 | 11/1989 | Friel | 219/219 |
| 4,940,317 | 7/1990 | Reuben | 219/219 |

*Primary Examiner*—Bruce A. Reynolds
*Assistant Examiner*—John A. Jeffery
*Attorney, Agent, or Firm*—Klarquist, Sparkman, Campbell, Leigh & Whinston

[57] ABSTRACT

A resistive sheet electrical mirror heater is provided for defogging a bathroom mirror. The heater may be retrofitted to a standard wall-mounted mirror. An elongated frame member rests along the top of the mirror and contains electrical circuitry. A planar heater sheet extends downwardly from and is supported by the frame member between the mirror and the wall. A power cord for connecting directly to a household outlet may extend from either end of the frame member.

8 Claims, 2 Drawing Sheets

MIRROR DEFOGGER WITH ELONGATED FRAME MEMBER AND DOWNWARDLY EXTENDING HEATER SHEET

TECHNICAL FIELD

This invention relates to an apparatus for removing and avoiding condensation on a mirror, and more particularly to apparatuses that may be retrofit to standard bathroom wall mirrors.

BACKGROUND ART

The problem of condensation on mirrors is well known. In warm and humid environments such as bathrooms, ventilation fans are used to exhaust humidity from such environments, but their effect is slow, and is wasteful of heat energy in cold climates.

Mirror condensation can be eliminated by heating the mirror directly. A common approach is to use built in resistive electrical heating elements to provide such heat such as is shown in U.S. Pat. Nos. 3,160,736 and 4,857,711.

The Spencer patent, U.S. Pat. No. 4,665,304, discloses a sheet-like heating element that can be mounted behind a sheet of conventional mirror glass. While the Spencer heating element may be attached to unmounted conventional mirrors, it is not easily retrofitable to an installed mirror. As shown in FIG. 8 of the Spencer patent, a transformer 20 in a junction box 19 and a cable enclosure 15 protrude from the rear of the mirror heater, necessitating cutouts in the wall on which the mirror is mounted. Installation, therefore, is difficult and expensive. The Spencer apparatus is not usable where holes may not be cut in the wall (i.e. in rental units and sites using masonry construction).

SUMMARY OF INVENTION

It is an object of the present invention to provide a laminar electric heater for simple retrofit installation to a wall mounted mirror without requiring modifications to the wall or mirror.

A further object of the present invention is to provide a mirror heater which may be powered by standard household current.

It is yet another object of the invention to provide a mirror heater that presents an aesthetic appearance.

It is yet another object of the invention to provide a mirror heater that may be easily and quickly installed and removed.

The invention achieves these and other objects by providing an apparatus having a laminar electrical heater sheet adapted to be received between a standard mirror and a wall, the heater sheet being attached to a frame member that is sized to slip over and be supported by the top edge of the mirror and which has a channel to conceal the heater control circuitry therein. The front surface of the frame member is the only visible element of the apparatus, which is powered by standard household current.

DETAILED DESCRIPTION OF A PREFERRED EMBODIMENT

Figure 1:
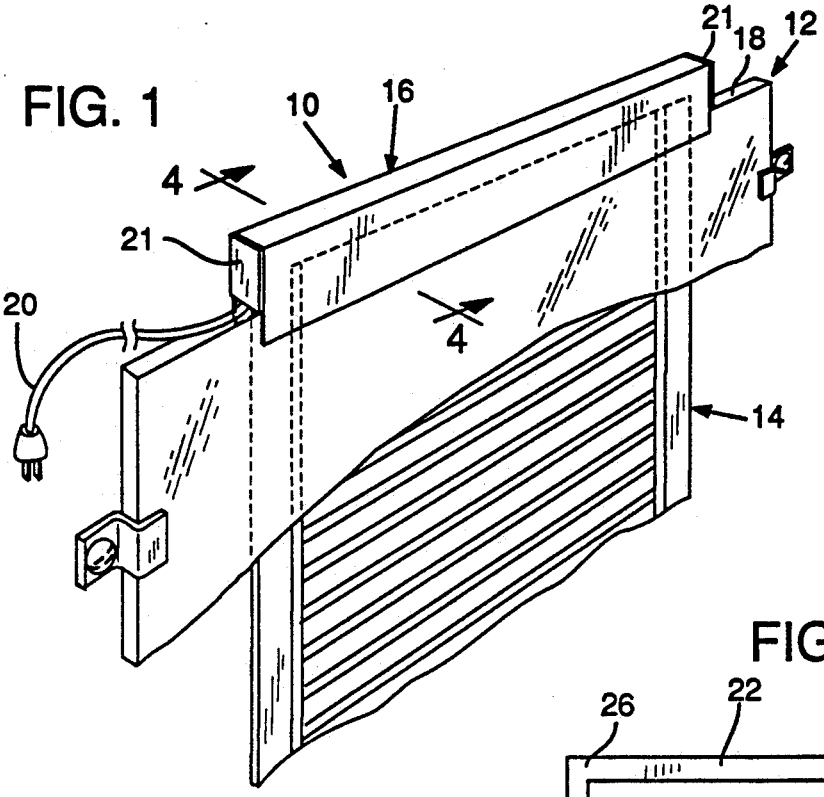
FIG. 1 is a perspective view of an apparatus constructed in accordance with the invention.

Referring to the drawings, FIG. 1 illustrates a resistive sheet electrical mirror heater 10 constructed in accordance with the invention as a retrofit installation on a wall mounted mirror 12. Generally speaking, a heater sheet 14 is received behind the mirror and is retained in place by a frame member 16 that rests on a top edge 18 of the mirror 12. A dual conductor power cord 20 provides a source of power to electrical circuitry (shown schematically in FIG. 6) concealed within the frame member 16, which is terminated by end caps 21.

Figure 2:
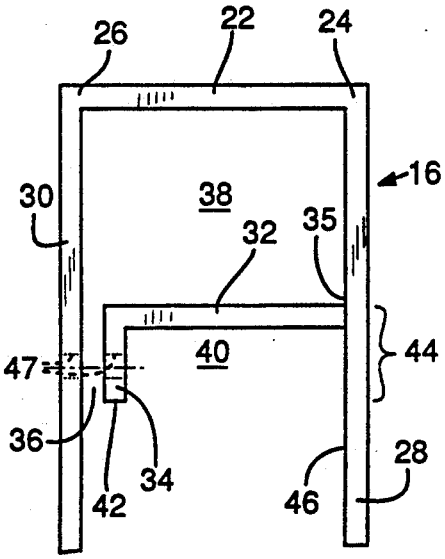
FIG. 2 is an enlarged end view of the frame member of the apparatus of FIG. 1 with an end cap removed.

Referring to FIG. 2, the frame member 16 is preferably of extruded plastic and is of generally U-shaped cross section. The frame member has a horizontal rectangular top panel 22, having a front edge 24 and an opposed rear edge 26. A flat elongated rectangular front panel 28 depends downwardly from the top panel 22 at the front edge 24. A similar rear panel 30 depends downwardly from the rear edge 26 of the top panel in an opposed parallel spaced-apart relationship to the front panel.

An L-shaped support member 32 is attached to an intermediate point 35 on the front panel 28 and extends perpendicularly toward the rear panel 30. A support leg 34 parallel to the rear panel 30 and spaced therefrom, defining therebetween a heater sheet gap 36, extends downwardly from the support member 32. The support leg 34 terminates at a lower leg end 42. The support member 32 extends to within about ½ inch of each end of the frame member 16. In the preferred embodiment, two horizontally aligned and laterally spaced fastener holes 47 are drilled through an intermediate position on the support leg 34 and through a corresponding position on the rear panel 30.

An electrical control channel 38 is defined within the frame member 16 by the top panel 22, the support member 32, the front panel 28 and the rear panel 30. A lower wire channel 40 is defined in the space immediately below the support member 32 between the support leg 34 and the front panel 28, See FIG. 4.

Figure 3:
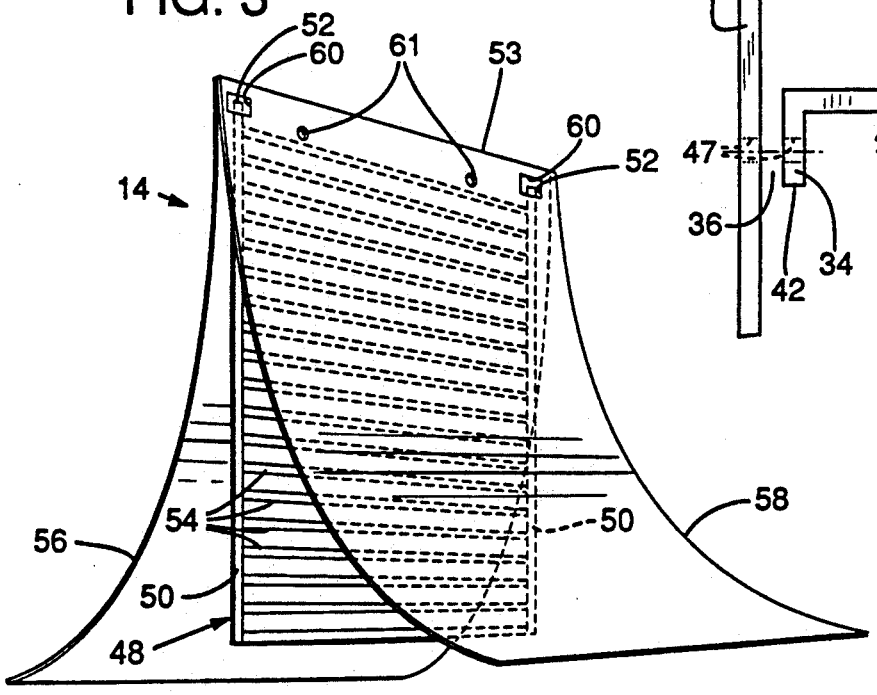
FIG. 3 is a perspective view of a partially assembled heater sheet of the apparatus of FIG. 1.

Referring now to FIG. 3, the heater sheet 14 may be any rectangular electric resistance heater of a thin flexible laminar construction as is well known in the art. In the illustrated embodiment, a central layer 48 comprises a pair of vertical conductive foils 50 consisting of spaced-apart elongated strips of metal such as copper or aluminum. The foils terminate at their upper ends at connector pads 52. A plurality of vertically spaced horizontally oriented resistive heating elements 54 are connected in an electrically parallel arrangement, each spanning from one conductive foil to the other. Each resistive heating element is an elongated wire or strip of a high resistance conductor such as is commonly used in automotive window defoggers.

As further shown in FIG. 3, the central layer 48 of the heater sheet 14 is sandwiched between a rear cover sheet 56 of electrically non-conductive plastic and a front cover sheet 58 also of electrically non-conductive plastic. Each cover sheet 56, 58 is generally rectangular and is slightly larger than the central layer 48 so that the cover sheets extend outwardly beyond the central layer on all edges, with the pads 52 closely adjacent the upper edge of the cover sheets. The cover sheets are laminated adhesively or by other suitable means. The front cover sheet 58 defines a pair of connector apertures 60 that correspond to the connector pads 52, and which provide electrical access to the pads. The heater cover sheet 58 further defines a pair of sheet holes 61 punched in a configuration to align with the fastener holes 47 of the frame member 16 when the heater sheet is installed in the frame member as shown in FIG. 1.

Figure 4:
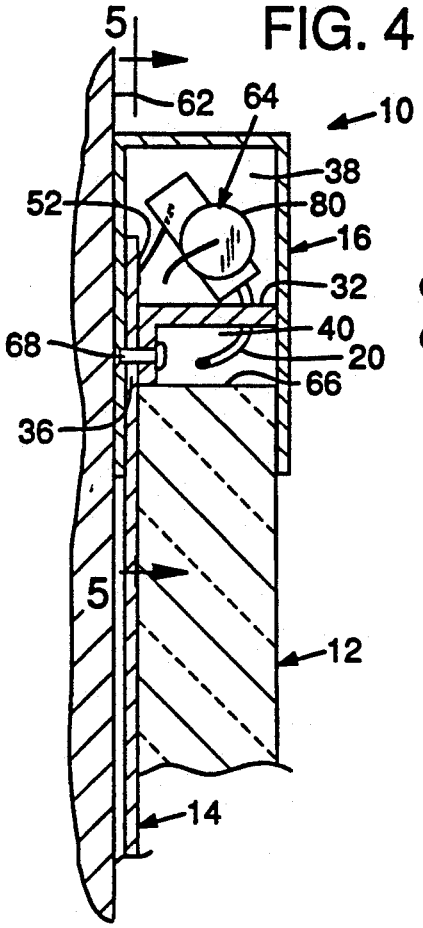
FIG. 4 is an enlarged fragmentary sectional view of the apparatus of FIG. 1 taken along line 4—4 of FIG. 1 showing the same as mounted to a wall.
Figure 6:
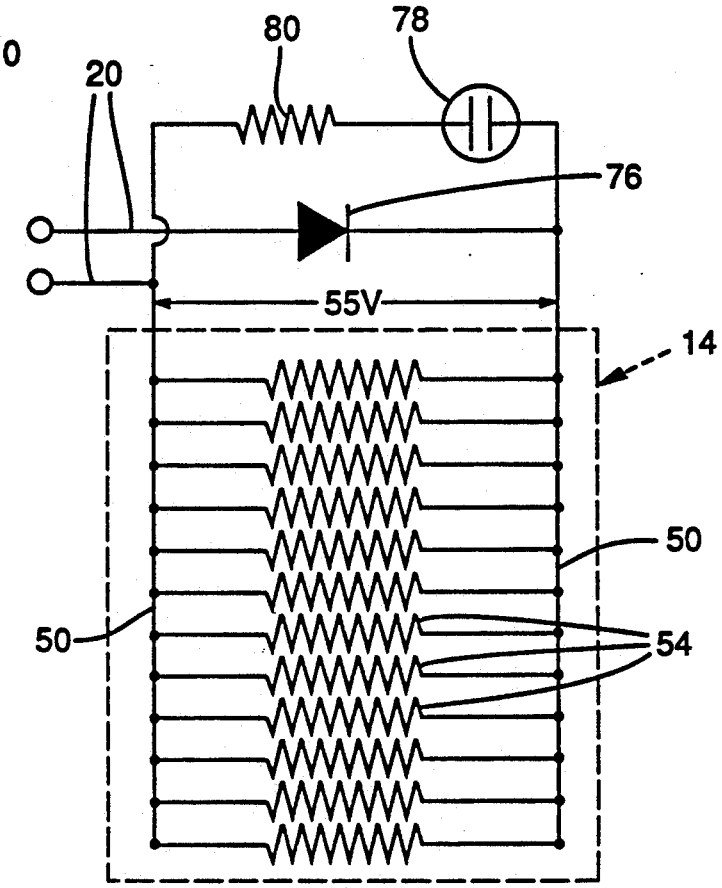
FIG. 6 is a schematic electrical diagram of the apparatus of FIG. 1.

As shown in FIG. 4, the heater sheet 14 is received within the heater sheet gap 36 of the frame member 16 so that the connector pads 52 are entirely positioned within the electrical control channel 38 and so that the sheet holes 61 are registered with the fastener holes 47. Suitable electrical control means 64, as will be discussed below with reference to FIG. 6, is provided to reside entirely within the electrical control channel 38. The control means is electrically connected to the heater sheet 14 at the connector pads 52 and transmits the electric power to be dissipated in the form of heat by the heater sheet. Fasteners such as plastic rivets 68 secure the heater sheet 14 to the frame member at the registered sheet holes 61 and fastener holes 47. Alternatively, the heater sheet may be attached to the frame member by staples, adhesives, or thermal or ultrasonic welding.

The assembled mirror heater 10 is installed by sliding the heater sheet 14 into a space between a wall 62 and the mirror 12, which is attached in spaced relation to the wall in a conventional manner by suitable fasteners. The heater sheet is inserted behind the mirror until the frame member 16 encounters the top edge 18 of the mirror. The mirror top edge is received between the heater sheet 14 and the front panel 28 of the frame member 16 so that the top edge 18 abuts the lower leg end 42 of the support leg 34 as shown in FIG. 4. It is contemplated that the heater sheet may be coated with adhesive to assure direct thermal contact between the heater sheet and the mirror.

Figure 5:
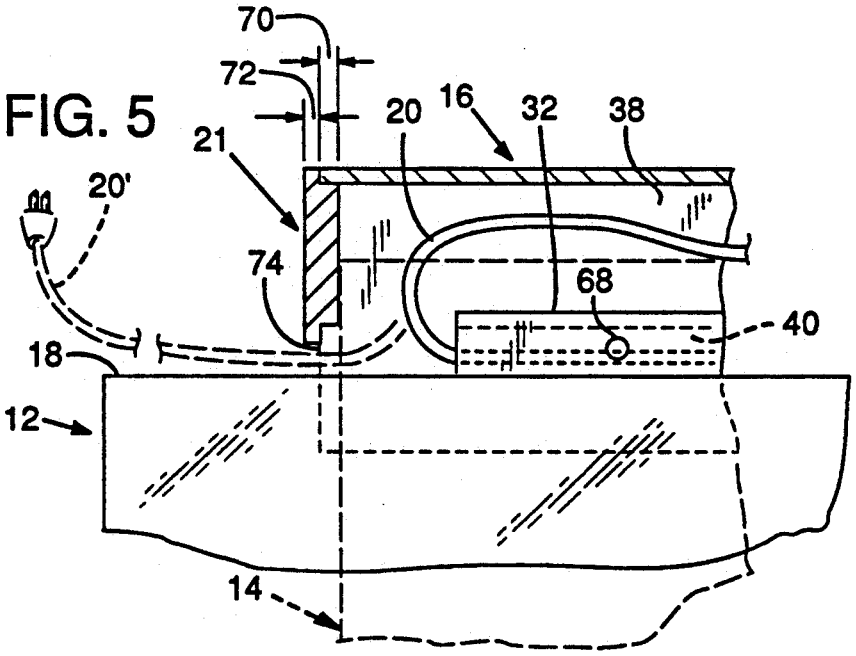
FIG. 5 is an enlarged sectional view of the apparatus of FIG. 1 taken along line 5—5 of FIG. 4.

As shown in FIG. 5, the end cap 21 has a plug portion 70 that is adapted to be closely received within the electrical control channel 38. An integral flange portion 72 attached to the plug portion extends beyond the plug portion on all sides to abut the end of the frame member 16 and to create a generally flush surface with the top, rear and front sides thereof. The end caps are secured by any suitable means. Each end cap 21 is sized to define, when installed in cooperation with the frame member, an exit aperture 74 between the end cap and the top edge 18 of the mirror 12 at each end of the frame member. Each exit aperture 74 is sized to permit the power cord 20 to freely pass therethrough so that the power cord 20 may extend from the frame member at either end of the assembly depending on whether the household power outlet (not shown) is on the right or left side of the mirror 12. When the power outlet is on the right side of the mirror as viewed in FIG. 1, the cord 20' (shown in dashed lines in FIG. 5) extends directly from the electrical control channel 38 out of the frame member. When the power outlet is on the left side of the apparatus as viewed in FIG. 1, the cord 20 (shown in solid lines in FIG. 5) is doubled back to extend beneath the support member 32 and through the wire channel 40 until the cord 20 exits the left side of the frame member 16.

FIG. 6 shows an schematic electrical diagram of the heater. The resistive heating elements 54 are connected in parallel between the pair of conductive foils 50. Each foil is connected to a respective conductor of the power cord 20. A diode 76 is included in series between one of the power cord conductors and one of the conductive foils 50. The diode preferably has a rating of 400 volts and one amp, which is sufficient to reduce the to 55 volts. This simple voltage reduction avoids the need for bulky transformers and has been shown to provide sufficient heat to the mirror without the safety hazards associated with excessive heating.

An optional neon lamp 78 and resistor 80 may be serially connected across the conductive foils 50, in parallel with the resistive heating elements 54. The lamp and resistor may be contained within the electrical control channel 38 to provide an illuminated indication that power is being supplied to the heater. A lamp hole (not shown) may be provided in the frame member 16 to transmit light from the neon lamp or, alternatively, the frame member 16 may be fabricated of a translucent plastic material thereby permitting light from the neon lamp to diffuse therethrough.

While the heater may be provided with a power switch in line with the power cord, the heater will preferably be connected to a switched outlet on the same circuit as a bathroom light fixture or exhaust fan.

Having illustrated and described the principles of my invention by what is presently a preferred embodiment, it should be apparent to those persons skilled in the art that the illustrated embodiment may be modified without departing from such principles. I claim as my invention, not only the illustrated embodiment, but all such modifications, variations and equivalents thereof as come within the true spirit and scope of the following claims.

I claim:

1. A resistive sheet electrical mirror heater for defogging a rectangular mirror having a horizontal top edge fixed proximate to a mounting surface, the heater comprising:

an elongated frame member having a U-shaped cross section, the frame member comprising an elongated top panel with opposed spaced-apart elongated front and rear panels depending downwardly therefrom, the front and rear panels defining a channel therebetween sized to receive a portion of a top edge of a mirror, the front and rear panels having opposed inwardly facing surfaces;

a planar heater sheet having electrically resistive heating elements, the sheet having an upper edge attached to the rear panel of the frame member and a lower portion comprising the majority of the area of the sheet depending downwardly therefrom, the entire lower portion being positioned at a level below the entire frame member with the sheet being suspended solely from above by the frame, the lower portion of the heating element being adapted to be positioned between the mirror and the mounting surface; and electrical control means for providing power to the heater sheet, the control means being adapted to be connected to an external source of power and substantially contained within the channel of the frame member.

2. The heater of claim 1 wherein the frame member has an end cap attached at each end to enclose the space therein.

3. The heater of claim 1 wherein the frame member includes a support member within the channel to align the frame member with the top edge of the mirror.

4. A retrofit mirror defogger for heating a rectangular sheet glass mirror mounted on a wall surface, the defogger comprising:

an elongated channel member configured to receive a top edge of the mirror;

a planar sheet heating element suspended solely from the channel member, the heating element having a lower portion comprising a majority of the sheet area and depending downwardly from the channel member, the entire lower portion being positioned at a level below the entire channel member, and the lower portion adapted to be positioned in laminar contact between the mirror and the flat surface.

5. A retrofit mirror defogger for heating a rectangular sheet glass mirror mounted on a wall surface, the defogger comprising:

an elongated channel member configured to receive a top edge of the mirror;

a planar sheet heating element suspended solely from the channel member, the heating element having a lower portion comprising a majority of the sheet area and depending downwardly from the channel member, the entire lower portion being positioned at a level below the entire channel member, and the lower portion adapted to be positioned in laminar contact between the mirror and the flat surface; and an electrical control means for providing power to the heating element, the control means being adapted to be connected to an external source of power and being substantially contained within the channel member.

6. A retrofit mirror defogger for heating a rectangular sheet glass mirror mounted on a wall surface, the defogger comprising:

an elongated channel member configured to receive a top edge of the mirror;

a planar sheet heating element suspended solely from the channel member, the heating element having a lower portion comprising a majority of the sheet area and depending downwardly from the channel member, the entire lower portion being positioned at a level below the entire channel member, and the lower portion adapted to be positioned in laminar contact between the mirror and the flat surface; and a pair of end caps, each attached to a respective end of the channel member.

7. A fog-free apparatus including:

a vertical wall;

a mirror fixed proximate to the wall with a gap defined therebetween, the mirror having a width;

a heater comprising an elongated channel member having a length less than the width of the mirror, configured to receive the top edge of the mirror and to be supported thereby, the heater also comprising a planar sheet heating element depending downwardly from the channel member and positioned between the mirror and the wall; and an electrical control means for providing power to the heating element, the control means being adapted to be connected to an external source of power and being substantially contained within the channel member.

8. A fog-free mirror apparatus including:

a vertical wall;

a mirror fixed proximate to the wall with a gap defined therebetween, the mirror having a width;

a heater comprising an elongated channel member having a length less than the width of the mirror configured to receive the top edge of the mirror and to be supported thereby, the heater also comprising a planar sheet heating element depending downwardly from the channel member and positioned between the mirror and the wall; and a pair of end caps, each attached to a respective end of the channel member.

* * * * *

UNITED STATES PATENT AND TRADEMARK OFFICE

CERTIFICATE OF CORRECTION

PATENT NO. : 5,302,809

DATED : April 12, 1994

INVENTOR(S) : Abby Ghiassy

It is certified that error appears in the above-identified patent and that said Letters Patent is hereby corrected as shown below:

Column 4, line 9, ". . . to reduce the to 55 volts." should be --. . . to reduce the voltage across the heating elements 54 from 110 volts AC to 55 volts.--

Signed and Sealed this

Thirteenth Day of September, 1994

*Attest:*

*Attesting Officer*

Bruce Lehman

BRUCE LEHMAN

*Commissioner of Patents and Trademarks*